United States Patent [19]

Bur sek et al.

[11] Patent Number: 4,821,502

[45] Date of Patent: Apr. 18, 1989

[54] METHOD OF AND APPARATUS FOR CONTROLLING THE YARN SPINNING-IN IN THE OPEN-END SPINNING PROCESS

[76] Inventors: Frantisek Bur sek, 315 Dukla; Jirí Sloupensk , 1345 Na pláni; Miroslav Boucek, 319 Dukla; Frantisek Hortlík, 382 Dukla; Jirí Bace, 323 Dukla, all of Ûstí nad Orlicí ; Zdenêk Silar, 1043 Na bílé ; Jiri Kutlvasr, 678 Erbenova, both of Chocen, all of Czechoslovakia

[21] Appl. No.: 49,762

[22] Filed: May 12, 1987

Related U.S. Application Data

[63] Continuation-in-part of Ser. No. 777,836, Sep. 19, 1985, abandoned.

[30] Foreign Application Priority Data

Sep. 26, 1984 [CS] Czechoslovakia ..... 7261-84

[51] Int. Cl.[4] ..... D01H 7/885; D01H 15/02

[52] U.S. Cl. ..... 57/263; 57/302

[58] Field of Search ..... 57/263, 264, 302, 404, 57/405; 226/11, 33, 27

[56] References Cited

U.S. PATENT DOCUMENTS

| | | | |
|---|---|---|---|
| 4,033,107 | 7/1977 | Sasayama et al. | 57/263 X |
| 4,178,749 | 12/1979 | Stahlecker et al. | 57/263 |
| 4,489,544 | 12/1984 | Morita et al. | 57/263 X |
| 4,628,684 | 12/1986 | Morita et al. | 57/263 |

FOREIGN PATENT DOCUMENTS

| | | | |
|---|---|---|---|
| 2032968 | 5/1980 | United Kingdom | 57/264 |

*Primary Examiner*—Stuart S. Levy
*Assistant Examiner*—Joseph J. Hail, III

[57] ABSTRACT

A process of automatic yarn spinning-in in the spinning unit of an open-end rotor spinning machine of an automatic service device provided with a control unit having a programmable microprocessor control system for controlling the spinning-in cycle and the automatic adjustment of spinning-in parameters modified according to successive verifying tests which are performed by the automatic service device which is either arranged in the individual spinning units, or as a unit traveling along the machine. By successive tests, spinning-in parameters are adjusted for an interval for yarn return to the spinning rotor as well as for determining the start of fiber feeding. The spinning-in parameters can be corrected by further verifying tests in spinning units with various dynamic characteristics.

8 Claims, 6 Drawing Sheets

METHOD OF AND APPARATUS FOR CONTROLLING THE YARN SPINNING-IN IN THE OPEN-END SPINNING PROCESS

This application is a continuation-in-part of copending application Ser. No. 777,836 filed Sept. 19, 1985 now abandoned..

BACKGROUND OF THE INVENTION

The invention relates to a method of controlling the process of spinning-in yarn in units of open-end spinning machines as well as to an apparatus for carrying out the method.

The heretofore known processes of automatically controlling the yarn spinning-in in open-end spinning machines have been performed by means of automatic service units operating in a spinning-in cycle preadjusted or programmed for a given yarn count, wherein at the start of the spinning rotor a controlled spinning-in process takes place, in which the take-off speed of yarn to be spun-in is governed by an increasing speed of revolution of the spinning rotor while the sliver supply speed corresponds to the yarn take-off speed (West-German Published Patent Application Nos. 2,321,775 and 3,144,760); alternatively, the sliver supply speed is regulated according to the entire yarn draft predetermined for the spinning process (West-German Publ. patent application No. 3,144,761), or the complete spinning-in process is controlled by means of complicated controlling elements which are designed for recording various quantities picked up during the start of the spinning rotor whereupon on the basis thereof yarn is returned into the rotor for being spun-in (West-german Publ. patent application No. 3,144,776).

However, any correct adjustment of the spinning-in cycle for a given yarn count in an automatic service device traveling along the spinning units of the machine, or in individual automatic units operating in each of the spinning station, is a rather complicated procedure since the spinning-in process depends on a plurality of variable quantities, and because of the fact that, due to various characteristics of textile materials, there does not yet exist and probably will never be found an exact mathematic model that would enable such a cycle to be calculated. For this reason, the spinning-in cycle by which the sequence of operations of the central automatic service unit or the individual service devices is determined is adjusted empirically, depending upon the operator's experience according to the type of fibrous material processed on a selected spinning station of the machine.

Even if the spinning-in cycle in the respective spinning unit is satisfactorily adjusted, a different quality of splice spots occurs in the other stations. This is caused by tolerances in the manufacture of individual elements of the spinning units by the wear of differentially stressed parts thereof, by different thrusts of the driving belts or the like. By this, of course, also dynamic characteristics of the individual spinning units vary during the spinning-in process, which results not only in a considerably wide spectrum of appearance and strength values of the yarn splice spots but also in an unreliability of the spinning-in process itself which has to be repeated several times, especially in the cases wherein the dynamic characteristics of spinning units vary excessively.

In the spinning-in process it is necessary to be relatively precise in determining some spinning-in parameters. One such parameter is the length of yarn to be returned from an initial position to the collecting groove of the spinning rotor, this length having to be determined before the start of the spinning-in process. To obtain a splice joint of high quality, a relatively precise yarn length has to be deposited onto the fibrous ribbon in the collecting groove of the spinning rotor.

This yarn length spinning-in parameter has hitherto been determined experimentally by the operator and the thus ascertained value has been adjusted or set up in a service unit. There are a number of known types of such service units, wherein the yarn length to be returned, or the adjustment thereof, is effected either by timing elements, or by means of a cam and adjustable switches (cf. Brit. Pat. 1,458,435), or by means of pulse counters (cf. U.S. Pat. No. 4,102,116 or 4,033,107).

Once adjusted, the yarn length spinning-in parameter can be modified, either by the operator, or automatically, in dependence on actually ascertained values within the scope of certain tolerances (cf. DE-OS No. 29 44 219=CS 210,059). Such a measure has been characterized in that it has respected some manufacturing tolerances, wear of variously stressed parts of spinning units, which means that various dynamic properties of spinning units and their changes have been taken into account.

As hereinabove set forth, this yarn length spinning-in parameter has had, however, to be ascertained preliminarily and experimentally. Such an adjustment or determination of this parameter is relatively time-consuming and therefore disadvantageous, particularly in those cases where changes of yarn count (in tex) and/or rotor diameter in the machine frequently occur. Apart from this, such a method is, owing to the splice joint quality, inaccurate and has to be modified by means of a control device and respective tuning elements provided in the automatic service unit.

In spinning-in process it is also necessary to be relatively precise in determining the amount of fibers to be supplied into the spinning rotor in order to obtain a desired quality of splice joint. As known from the British Patent Specification No. 1,458,435, the instant of starting the fiber supply to the spinning rotor since the start of spinning-in process is determined by time metering means whose values are adjustable. In this way, the fiber supply period up to the yarn take-off instant can be set up. This time period which is called the fiber supply spinning-in parameter, gives the fiber amount to be supplied to the spinning rotor up to the yarn take-off start in order to produce a fibrous ribbon in the collecting groove of the spinning rotor, onto which the yarn end is to be deposited in the spinning-in process. This time period must always be predetermined and set up in the corresponding electrical circuit of the spinning-in mechanism. This period has hitherto been ascertained experimentally for every yarn count (in tex), which means that a presupposed value has been set up, and after the inspection of splice joint quality, the set up value has been corrected, if necessary.

According to the German DE-OS No. 2,944,219, a value set up in a time program is compared with a value actually ascertained in a comparing element 7 whereupon the set up values are corrected by a correcting element 4 with respect to correction values defining the admissible time tolerances. Thus, the differences between the actual value and the set up value are corrected either by the operator, or automatically, but always within the range of tolerance limits. This means that it is always necessary to determine the fiber supply spinning-in parameter with regard to the yarn count (in tex) and the spinning rotor diameter, which is disadvantageous, particularly with machines where spinning rotors are frequently exchanged for other ones with different diameters, with regard to the character of fibers to be processed, or where the yarn count is frequently changed.

As disclosed in the U.S. Pat. No. 4,178,749, the splice joint quality, after a programmed spinning-in process, is inspected and evaluated, and in case of an objectionable value, an intentional breakage is effected and the programmed spinning-in process is repeated. The patent does not solve and does not predetermine the fiber supply spinning-in parameter, either. Yet, in this case as well, this parameter has to be predetermined and stored into the program.

Thus it is necessary for carrying out the known spinning processes that the operator may know such a primary or initial adjustment of an automatic service unit, in order to obtain a splice joint at all, although its quality may be questionable. This means that the first adjustment of the automatic service has to be either estimated or effected according to experience, which, with a considerable variability of fibrous material properties in view, is troublesome. It is particularly the determination of the fiber supply spinning-parameter where other processes, such as final combing-out of fibers from fibrous beard by the opening cylinder even after stopping the fiber supply, play their part, that is relatively time-consuming.

According to Czechoslovak Inventor's Certificate No. 210,059, it has been proposed to equip the driving means of spinning stations with adjusting elements for tuning each of the spinning stations up to a desired level. For the time being, however, the installation of such means is too expensive and, apart from this, the operation thereof requires the intervention of the operator who will thereby lose a part of his work capacity.

SUMMARY OF THE INVENTION

It is an object of the present invention to eliminate the disadvantages of the prior art as hereinabove set forth, and to provide an improved method of and an apparatus for controlling the yarn spinning-in process in spinning units of open-end rotor spinning machines. The invention makes it possible to achieve an objective adjustment of the spinning-in cycle which can be accommodated to the conditions of the individual spinning units even during the machine operation, and which does not depend on the operator's decision.

It is a further object of the invention to provide a method of determining the spinning-in parameter of total yarn length to be returned by means of a spinning-in apparatus which would relatively quickly and precisely ascertain the necessary length while taking different dynamic characteristics of individual spinning units into consideration, and which does not depend upon subjective operator's estimation.

It is yet a further object of the invention to provide a method of and an apparatus for automatically setting up a nonadjusted service unit, as to the fiber supply, immediately by a control system of the unit itself, i.e. autonomously, while changing textile-technological parameters, or rearranging the spinning unit, or in case of substantial change of climatic conditions, in order to effect such a fundamental adjustment of the automatic service unit that will eliminate any failure of the first spinning-in process.

According to the invention, the yarn spinning-in process is controlled by means of a service device provided with a unit for controlling the fiber supply and the return of yarn into the spinning rotor for being spun-in, and the method is characterized in that yarn is spun-in according to a spinning-in cycle of the controlling unit in which yarn spinning-in parameters are automatically adjusted according to successive verifying tests performed by the service device.

The automatic adjustment of spinning-in parameters by means of successive tests makes it possible to achieve, independently of human estimations, the yarn spinning-in under beneficial conditions which are established in accordance with the results of said successive verifying tests.

According to the invention, the adjustment of the spinning-in cycle in which there is determined, in the form of spinning-in parameters, the period of fundamental operational steps influencing the success of the spinning-in process, viz. the interval of yarn length to be returned into the spinning rotor, and time interval necessary for providing a sufficient fiber supply in said rotors, consists in that the spinning-in parameters are automatically adjusted partly according to successive tests to ascertain a suitable yarn length to be returned by reversing means, and partly according to successive tests to determine a suitable time point to initiate the supply of fiber to the spinning rotor by a feeding device.

In this way, it is possible to ascertain the yarn length to be returned into the spinning rotor during the spinning-in process by the reversing means of the service device, wherein the yarn tension arising by the contact of yarn end with the rotating rotor is responded to by appropriate means such as a yarn breakage feeler, whereupon by next verifying tests with successively varying start pulses for initiating the fiber supply there is ascertained by a suitable time point at which the fiber supply device of the spinning unit is set in operation by control means of the service device. By "suitable time point" it is to be understood a sufficient time advance for initiating the operation of the fiber feeding device relative to the returning yarn, said device ensuring a sufficient fiber reserve in the spinning rotor before spinning-in the returned yarn.

To achieve not only the reliable spinning-in of yarn but also a good quality of the splice spot or spots which, on the one hand, has to be sufficiently strong and, on the other hand, must not be too thick and too long, it is advantageous, according to the invention, when the parameters of splice spots in the spun-in yarn are detected by checking means, and the values of spinning-in parameters in the spinning-in cycle are tuned up by correcting them in dependence on the result of verifying tests relative to predetermined tolerances.

The thickness and length of the splice spots is predetermined and controlled by verifying tests according to the invention in such a manner that the correcting of the spinning-in parameters is carried out by varying the time point of initiating the supply of fibers to the spinning rotor or, optionally, by subsequently varying an interval for extending, or, respectively, shortening the length of yarn to be returned into the spinning rotor for being spun-in.

The control of the spinning-in process according to the above described method improves the yarn quality which also depends, apart from other factors, on the appearance and strength of the splice spot. If, after the spinning-in process, it is ascertained by checking means that the splice spot is too thin, or too thick, the start of feeding fibers into the spinning rotor is adjusted by changing the respective spinning-in constant, whereas the splice spot length is influenced by shortening, or prolonging the respective time interval of the spinning-in constant for returning yarn into the spinning rotor.

The automatic adjustment of spinning-in parameters of the spinning-in cycle of the control unit also makes it possible to achieve a reliable spinning-in process even with such a spinning unit which, due to its different dynamic characteristics, can be hardly primed, or wherein the yarn, after being spun-in, has a worse appearance relative to the other spinning units where the breakages are remedied according to the original parameters.

According to the invention, such a difference is corrected in that the spinning-in cycle is automatically modified by corrected values of the spinning-in parameters by performing the verifying tests in a spinning unit having different dynamic characteristics.

By this modification of the spinning-in cycle there are obtained good splice spots even in such spinning units in which the reliable yarn spinning-in process cannot be attained by any other means and where the spinning-in attempts have to be repeated with poor results.

According to the invention, it is further advantageous that the corrected values of the modified spinning-in cycle are stored in the memory of the controlling unit for being reused in a spinning unit having different dynamic characteristics.

By the automatically modifiable spinning-in cycle of the control unit for the individual spinning units there are also provided conditions for raising the productivity of the traveling automatic service device, the operation of which an also be extended onto other machines manufacturing various yarn counts. Such possibility with the existing travelling automatic devices is out of the question because of their fixed spinning-in cycles An apparatus for carrying out the method of controlling the spinning-in process by means of a service device, comprising a fiber supply and a yarn return controlling unit, consists according to the invention in that the controlling unit comprises a programmable microprocessor control system for controlling the spinning-in cycle and for automatically adjusting the spinning-in parameters, the system being provided with input circuits and output circuits, the former being coupled to checking means consisting of a control sensor, and to a pick-up for picking up the yarn length to be returned, while the output circuits are coupled to the drive control of a yarn reversing device, a take-off device and a fiber supply device.

Such an apparatus makes it possible not only to automatically adjust the spinning-in parameters of spinning-in cycle of the controlling unit, but also to modify said parameters for individual spinning units with different dynamic characteristics, which according to the invention is achieved in that the controlling unit is provided with a memory having memory cells for storing the corrected values of spinning-in parameters, the memory being connected through a bus bar with the input and output circuits of the microprocessor control system.

The possibility of reusing the spinning-in cycle with correction values of the spinning-in parameters modified by the service device with individual spinning units is obtained in that the memory cells are associated with the spinning units and designed for recording the corrected values of spinning-in parameters of t he cycle modified for these spinning units.

For the objective ascertainment of the yarn length to be returned in the spinning-in process into the spinning rotor by the service device it is advantageous according to the invention that the pick-up is a device for picking up an angle of reverse rotation of the yarn take-off device or the yarn reversing device, respectively.

Since it is very important, both for the fundamental adjustment itself Of the spinning-in cycle and for the modification thereof, to determined as precisely as possible, the yarn length to be returned in the spinning-in process into the spinning rotor. It is advantageous according to the invention that the device for picking up an angle of reverse rotation of the yarn take-off device or the yarn reversing device is a counter of pluses of a punched or toothed disc kinematically coupled to a driven cylinder of the respective device.

By the use of a pulse counter such as a photo-electric cell in co-action with a punched or toothed disc kinematically coupled with the roller of the take-off, or reversing device, respectively, it is possible to measure the yarn length to be returned with a relative preciseness whereby increased claims on the determination of said length in highly productive open-end rotor spinning machines are complied with.

According to the invention, the volume or thickness and length of a splice spot can be monitored by the control sensor such as a capacitance, or a photo-electric sensor. In case the checked splice spot does not correspond to the predetermined limit values of said capacitance, or photo-electric sensor, a signal for stopping the fiber feed to the spinning unit is released by the microprocessor control system coupled to said control sensor whereby an intentional yarn breakage is provoked. The microprocessor control system reacts analogously in case of an unwanted yarn breakage, wherein the control sensor assumes the function of a conventional yarn breakage stop motion.

Since the main condition of the successful yarn production is to maintain a high strength of the splice spot, it is advantageous according to the invention that the control sensor is a pick-up of axial tension.

Similarly, as with the use of a capacitance or a photoelectric sensor, it is possible to monitor the splice spot by said pickup of axial yarn tension, and to provoke, in case of surpassing a predetermined tolerance, an intentional yarn breakage by the microprocessor control system in the respective spinning unit.

An advantage of the inventive determination of the fiber supply spinning-in parameter is that it provides a relatively exact fiber supply value immediately by means of the service unit, i.e. independently on the operator's skill It is known that the first or initial spinning-in process is feasible with about 40–50% of fibers from an optimum amount requested for a given yarn count. It is just this fundamental fiber amount value that is ascertained up to the first spinning-in step by gradually adding time periods for the fiber supply after unsuccessful spinning-in steps whereupon after the first successful spinning-in step there is added to the ascertained value an optimalizing time period within which the remaining about 50% o fibers is added. It is afterwards only that the normal spinning-in process follows, wherein the quality of the process (length and weight of splice joint) is evaluated and some necessary corrections for the next spinning-in process are effected. The gradual time increase can be either linear (e.g. by 0.05 sec.) or progressive, in order to accelerate the process of determining the fiber supply spinning-in parameter. To eliminate a casual unsuccessful spinning-in process after the determination of spinning-in parameter, the optimalizing block is preferably coupled with a repeating control block for repeating the spinning-in steps with the set up or ascertained values.

Another advantage of the inventive method and apparatus is that the spinning-in parameter of the total yarn length to be returned to the spinning rotor in the spinning-in process is divided into two sections, a fundamental length value Z and a deposit length value U.

The fundamental length Z is influenced primarily by the dynamic properties of spinning unit and by the spinning rotor diameter. This value Z is defined during the yarn return by the generation of tension in yarn, i.e. by the instant in which the yarn end begins to be entrained by the spinning rotor. The tension is picked up by a control tension sensor which, via a corresponding electrical circuit, switches off the reverse motion of the driving device and simultaneously transmits this instant to an evaluating circuit. In this way there is obtained a relatively precise fundamental length value Z to which a deposit length value U is to be added.

The deposit length value U is influenced primarily by the yarn count (in tex). For each yarn count, the value U can be determined or calculated, respectively. The value U is given by the equation $U = 1.8 \log Tt$, wherein U is the deposit length in centimeters, and Tt is the yarn count in tex.

The deposit yarn length U which corresponds to the yarn count is adjustable in the electrical circuit in such a way that there is calculated an angle in a microprocessor system, by which a metering disc of a metering device is to be turned. The device is simultaneously designed to be used for sensing the yarn length being returned during the ascertainment of this length.

Another advantage of the invention is that the required total spinning-in parameter can be relatively quickly obtained for different yarn counts by setting up the yarn deposit length U since the fundamental yarn length Z remains practically constant. In case the spinning rotor is exchanged for another one of different diameter, there is also changed the fundamental yarn length Z to be returned which, however, is ascertainable relatively quickly in the manner as referred to above. The thus ascertained fundamental and deposit yarn length values are automatically registered into a corresponding memory block which is coupled to the corresponding spinning-in steps of the spinning-in mechanism.

The fundamental yarn length value Z is preferably ascertained for every spinning unit, and registered in a separate storing block which can be provided either in a traveling, or a stationary central service unit. When starting the open-end spinning machine when all of the spinning units have to be spun-in simultaneously, it is preferable to ascertain the fundamental yarn length value Z at least with two spinning units, preferably, however, with 5–10% of spinning units from the total number installed in the machine, and to calculate the average value. This, particularly, is important because of the fact that while stopping the machine, it is impossible to establish one and the same initial position of yarn end to be spun-in, said position varying within the range of up to 10 centimeters. The deposit yarn length U is preferably stored in a separate memory block.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

I. The Spinning Apparatus

Figure 1:
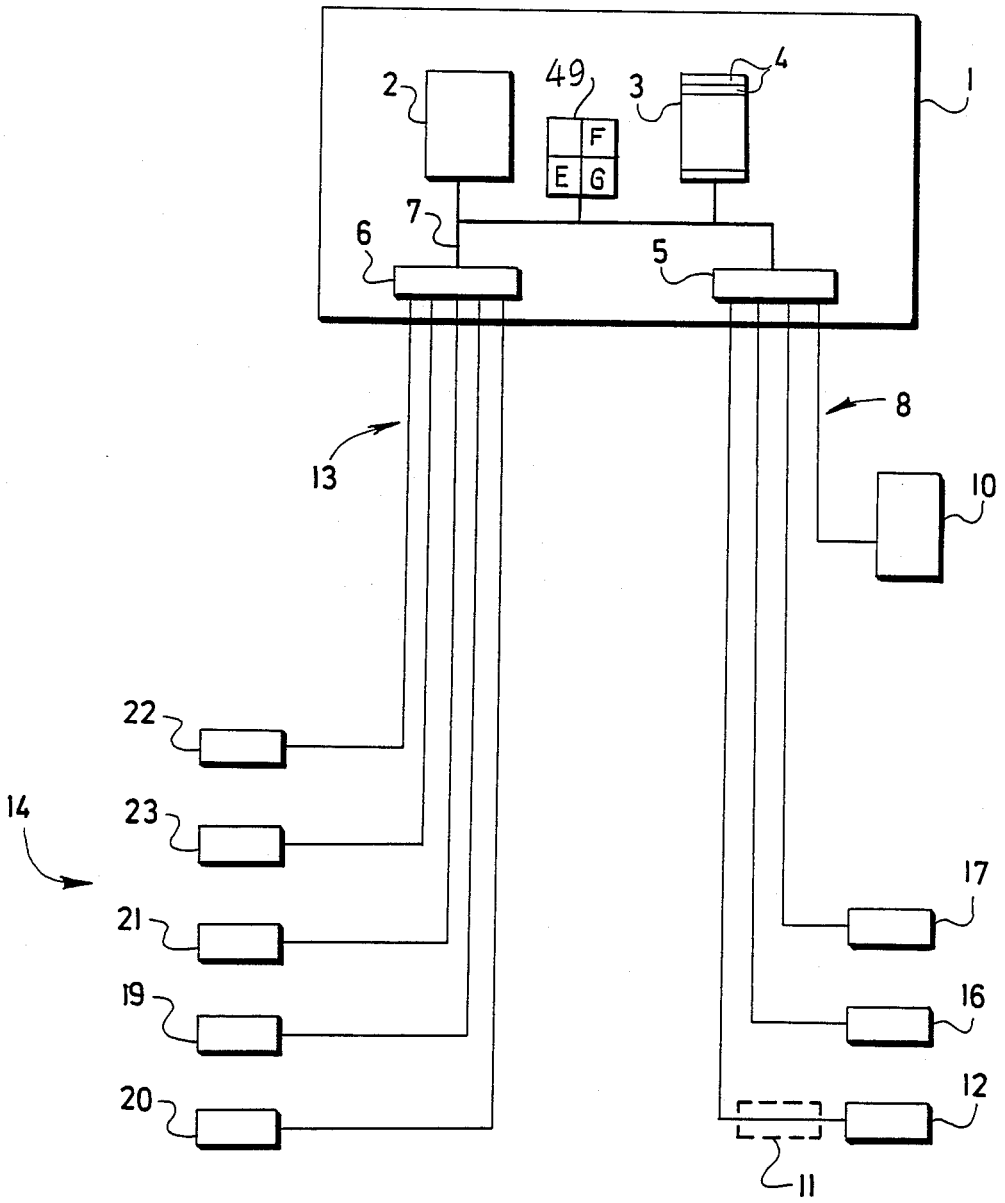
FIG. 1 is a block diagram of the apparatus.
Figure 4:
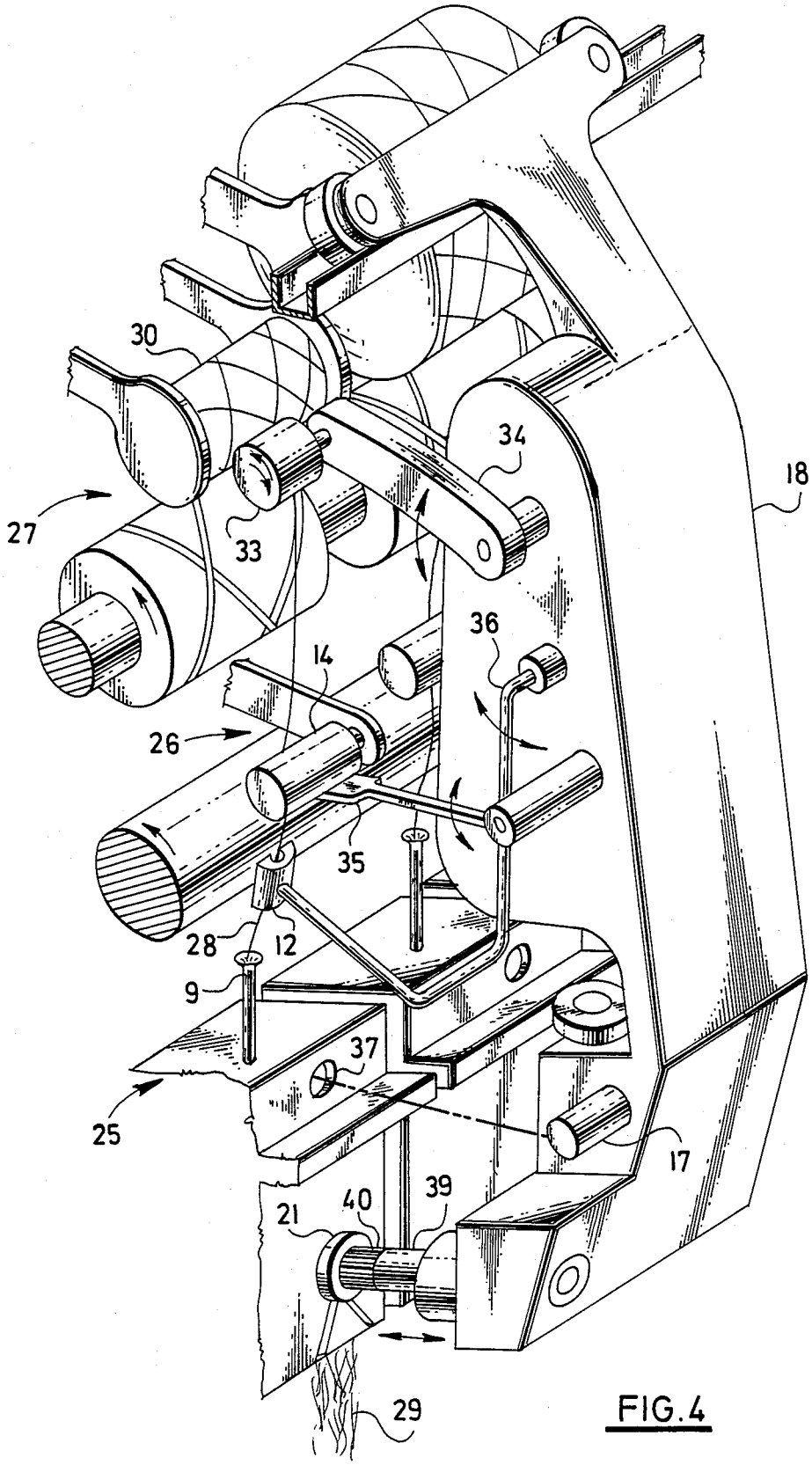
FIG. 4 is a detail view showing a part of the spinning unit together with a traveling automatic service device.

As can be seen in the drawings and particularly FIGS. 1 and 4 thereof, the apparatus of the invention consists of a control unit 1 comprising a micro-processor control system 2 which is connected via a bus bar 7 with a memory 3 and memory cells 4. To the bus bar 7 there are connected input and output circuits 5 and 6 (input and output interface). To said input circuits 5 there are connected, through inputs 8, a panel 10 for manual input for adjusting the fundamental spinning-in cycle, a cycle, an analog-to-digital converter 11 interconnected with a control sensor 12, a sensor 16 for detecting the yarn length to be retuned to a spinning rotor 22, and a sensor 17 of rotor speed. To the output circuit 6, there are connected, via outputs 13, means for controlling drives of reversing device 19, a yarn take-off device 20, a fiber feeding device 21, the spinning rotor 22 and a fiber opening cylinder 23. The arrangement of the micro-processor control system according to the invention does not exclude, however, the addition of further inputs and outputs for controlling other than spinning-in processes in open-end rotor spinning machines.

FIG. 4 shows an open-end spinning machine provided with an automatic service device 18 which is adapted to travel along side-by side arranged open-end spinning units 25 and which comprises a backing roll 33 mounted for swinging, in the direction of the curved arrows, of an arm 34 so as to lift a yarn package 30. The drive of said backing roll 33 is kinematically coupled to the drive of the yarn taking-off device 20 and the reversing device 19, said drive being controlled by said yarn length sensor 16. The traveling automatic service device 18 is further equipped with a swinging spoon 35 for thrusting a pressure roll 14 away from a take-off roller 26 and with the control sensor 12 attached to an arm 36 mounted for swinging in the direction of arrows. The spinning unit 25, which is provided with a thread breakage stop motion (not shown), has in its hood a hole 37. In the axis of said hole 37, the rotor speed sensor 17 is arranged on the service device 18. The fiber feeding device 21 of the spinning unit 25 can be driven, in the spinning-in process, independently by the end portion 40 of an advancing and retracting extension 39 arranged in the traveling automatic service device 18. In the spinning process, this drive is controlled by said micro-processor control system 2.

Figure 2:
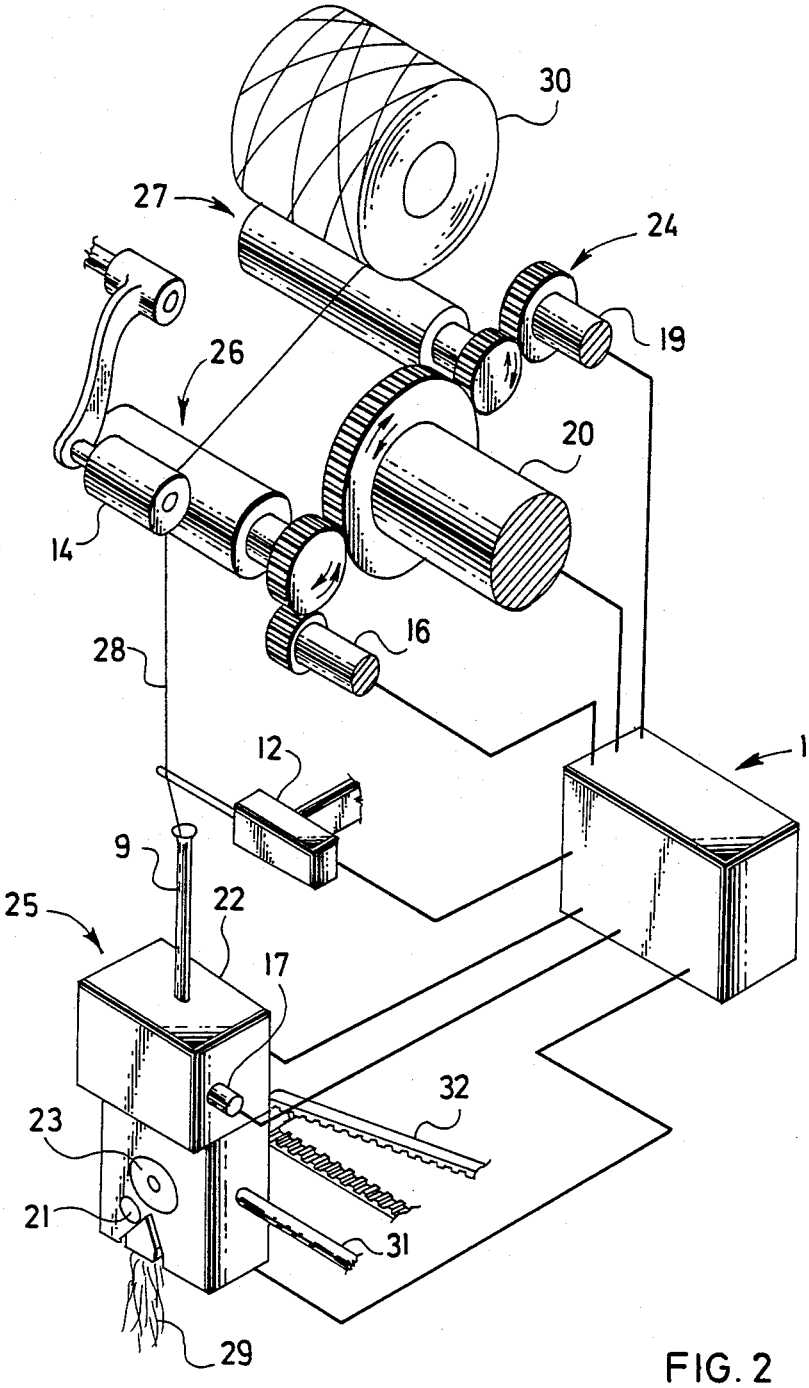
FIG. 2 is a perspective view of a spinning station of an open-end rotor spinning machine equipped with an individual automatic service device.

FIG. 2 shows an open-end spinning unit 25 equipped with its own automatic service device, all of said devices in the machine being centrally controlled by the control unit 1. Each of the spinning units 25 comprises a fiber feeding device 21 which is driven via a through shaft 31 and an electromagnetic coupling (not shown) controlled by both the micro-processor control system 2 and the control sensor 12. A supplied fibrous sliver 29 is opened by an opening cylinder 23 driven by a driving belt 32. The yarn take-off device 20 is coupled with the reversing device 19 as well as with the sensor 16 of the yarn length to be returned during the spinning-in process. The control unit 1 is also connected to the rotor speed sensor 17.

It is to be understood that the present invention is not limited to the embodiments as described and shown in the appended drawings but that it can be applied to other similar system arranged either on the traveling device, or immediately in each of the open-end spinning units.

II. The Spinning Process

In the spinning process, the sliver 29 is supplied to the spinning unit 25 by the positively driven feeding device 21 and conveyed thereby to the rotating opening cylinder 23 the clothing of which opens the sliver up to individual fibers. The latter are then supplied to the rotating spinning rotor 22 in which they are twisted to form yarn 28 to be withdrawn by the take-off roller 26 to which they are forced by the pressure roll 14. Yarn is finally wound on the package 30 by means of the spooling roll 27.

Before initiating the spinning-in process, the drives of the opening cylinder 23 and of the spinning rotor 22 are started by means of the control unit 1. After the desired speed of the spinning rotor 22 has been reached, as detected by the sensor 17, the micro-processor control system 2 verifies in a decision process R8 through memory cell 4 whether the spinning-in parameters of the spinning-in cycle of the control unit 1 should be newly adjusted, or whether said parameters have already been adjusted before by successive verifying tests. In the latter case the micro-processor control system 2 switches on the block of program J comprising cleaning the spinning rotor, reshaping the yarn end 281 (FIG. 5) to be introduced by not shown means of the service device at a predetermined distance from the spinning rotor, and spinning-in yarn by the service device according to the adjusted spinning-in parameters in the spinning-in cycle controlled by the micro-processor control system 2. At this instant given by the respective spinning-in constant, the fiber supply is initiated by the feeding device 21 whereupon within a time interval given by the next spinning-in constant, there is started the return of yarn by the reversing device 19 into the spinning rotor 22 from which, after spinning-in and switching off the drive of said device 19, the yarn begins to be withdrawn after the drive of the take-off device 20 had been switched on.

Figure 5:
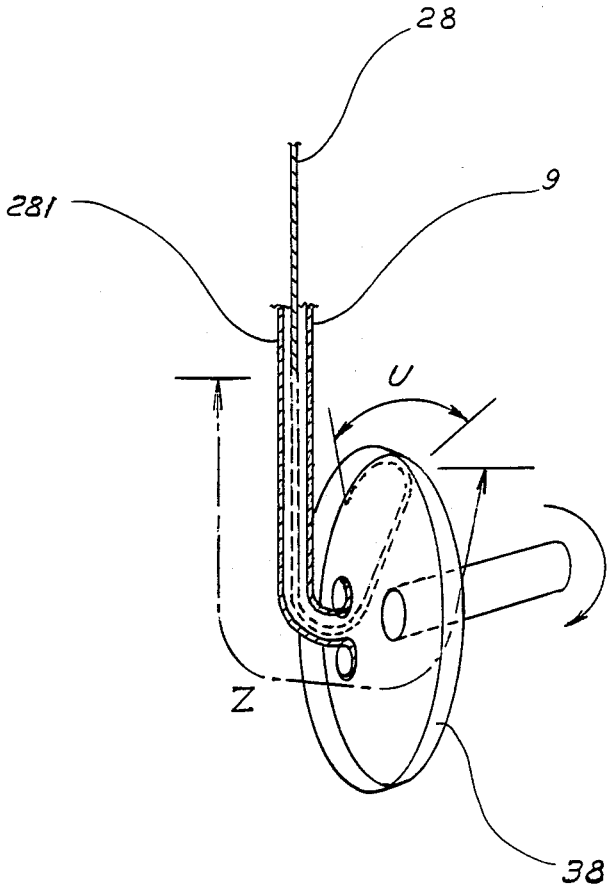
FIG. 5 is a schematic diagram of the spinning rotor and the associated yarn take-off tube in which the initial point of yarn end is indicated.

Referring to FIG. 5, fundamental yarn length value Z is defined during the yarn return by the generation of tension in yarn, i.e. by the instant in which the yarn end 281 begins to be entrained by the spinning rotor. This tension is picked up by a control tension sensor which, via a corresponding electrical circuit, switches off the reverse motion of the driving device and simultaneously transmits this instant to an evaluating circuit. In this way there is obtained a relatively precise fundamental length value Z to which a deposit length value U is to be added.

The deposit length value U can be determined or calculated, respectively. The value U is given by the equation $U=1.8 \log Tt$, wherein U is the deposit length in centimeters, and Tt is the yarn count in tex.

The deposit yarn length U which corresponds to the yarn count is adjustable in the electrical circuit in such a way that there is calculated an angle in a microprocessor system, by which a metering disc of a metering device 16 (FIG. 1) is to be turned. The device 16 is simultaneously designed to be used for sensing the yarn length being returned during the ascertainment of this length.

The required total spinning-in parameter can be relatively quickly obtained for different yarn counts by setting up the yarn deposit length U since t he fundamental yarn length Z remains practically constant. In case the spinning rotor is exchanged for another one of different diameter, there is also changed the fundamental yarn length Z to be returned which, however, is ascertainable relatively quickly in the manner as hereinabove referred to. The thus ascertained fundamental and deposit yarn length values are automatically registered into a corresponding memory block which is coupled to the corresponding spinning-in steps of the spinning-in mechanism.

The fundamental yarn length value Z is preferably ascertained for every spinning unit, and registered in a separate storing block B (FIG. 3) which can be provided either in a traveling, or a stationary central service unit. When starting the open-end spinning machine when all of the spinning units have to be spun-in simultaneously, it is preferable to ascertain the fundamental yarn length value Z at least with two spinning units, preferably, however, with 5–10% of spinning units from the total number thereof installed in the machine, and to calculate the average value. This, particularly, is important because of the fact that while stopping the machine, it is impossible to establish one and the same initial position of yarn end to be spun-in, said position varying within the range of up to 10 centimeters. The deposit yarn length U is preferably stored in a separate memory block C.

III. Adjustment of the Spinning-In Process

The adjustment of the spinning-in process will be more easily understood by reference to the flow chart shown in FIG. 3 where the portion of the figure designated with roman numeral I, above the dotted line, represents adjustment of parameters for initial spinning-in and the portion of the figure designated with roman numeral II, below the dotted line represents the normal spinning-in process, and wherein the following legend applies:

R8—decision process

R1—decision process for ascertaining the time of yarn return

B—storing in the memory cell 4, the ascertained spinning-in parameter of the yarn return length interval C—program containing the parameter stored therein after the addition of the spinning length D—block of program for directing the cleaning of the spinning rotor and re-shaping of the end of the yarn introduced at a predetermined distance of the spinning rotor E—program wherein device 21 is started at the instant given by the basic spinning-in parameter to fiber feeding R2—block of program verifying the signal from the control sensor 12 as to whether or not the yarn spinning-in process has or has not been completed F—program block wherein the initial fiber reserve in the rotor is increased by 1 degree relative to the adjustment of the basic spinning-in parameter F1—programming causing the operation to proceed F2—program block determining the number of successive verifying tests R10—decision process for repeating the search for automatically spinning-in parameter for detecting an appropriate yarn length to be returned, and a suitable instant for initiating the fiber feed to the spinning rotor G—program block for accelerating the optimization of the spinning-in process by modifying the respective parameter R5—decision process for varying the yarn spinning-in R3—decision process wherein the signal from the sensor 12 about the splice block volume is evaluated R4—decision process for evaluating the splice block length L—program block for monitoring the normal spinning process K—program block in which, after cleaning the spinning rotor and re-shaping the yarn end, the verifying test with unchanged spinning-in parameters is effected R7—decision process for repeating the verifying test as long as the yarn spinning-in is completed R4—decision process for evaluating the splice spot length H—program block which effects the tuning of the respective spinning-in parameter by a corrected value which is stored in the memory cell 4 of the respective spinning unit R9—the decision process evaluating the length of the splice spot I—program block in which a correction with a return yarn length is effected by correcting the spinning-in parameter J—program for carrying out the spinning-in process by the micro-processor control system 2

R6—decision process wherein the control sensor 12 ascertain whether the yarn spinning-in has been successfully completed FIG. 1 shows a control unit 1 comprising an electronically adjustable timer 49 for setting up, on the one hand, the fundamental fiber supply, and, on the other hand, for gradually adding time periods after unsuccessful verifying spinning-in steps up to first spinning-in process as well as for setting up the additional optimalizing time value.

Figure 3:
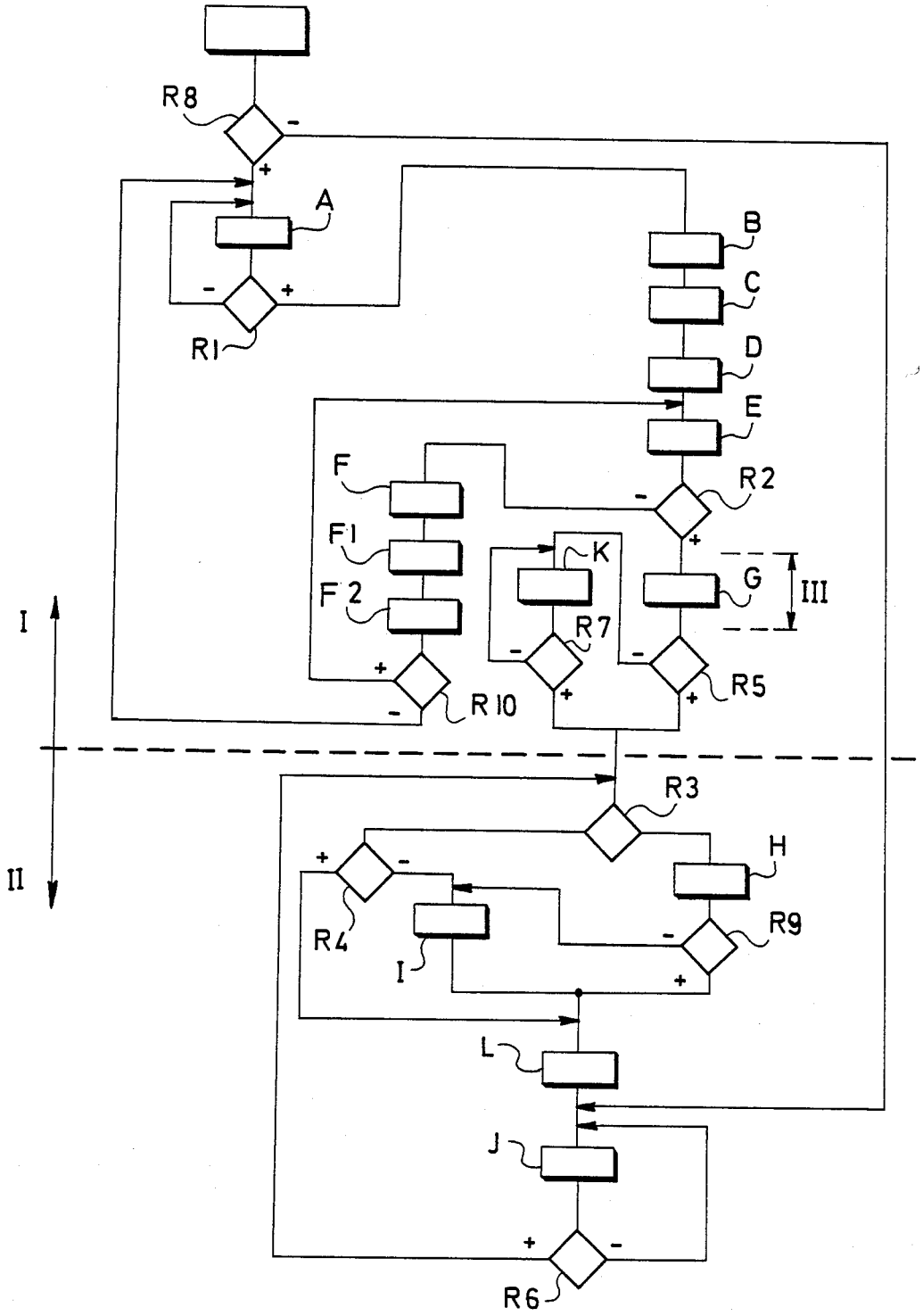
FIG. 3 is a flow chart showing the sequence of the operational steps of the apparatus.

FIG. 3 shows, in the form of a block diagram, a detailed operational wiring diagram of control unit 1 which comprises, on the one hand:

(1) A decision process R8 connected to the normal spinning-in block J and to the length verifying block A for ascertaining the yarn length to be returned;

(2) Normal spinning-in block J connected to decision process R6 (whose part is the control sensor 12) and further on to the splice joint quality evaluating circuit together with the decision process R3 for detecting the splice joint weight; the decision process R3 is coupled or followed by the splice joint weight correcting block H and by the decision process R4 for evaluating the splice joint length, which process R4 is followed either by the correcting block I for correcting the splice joint length or directly by the operation monitoring block L; the correcting block I is also followed by the decision block R9 for splice joint length, which is connected to said splice joint weight correcting block H and also directly to said operation monitoring block L;

(3) Said length verifying block A which is followed, via decision block R1, by the fundamental spinning-in parameter ascertaining block B and by the adding block C for determining the so-called additional yarn end spinning-in length to be deposited into the spinning rotor, said block C being followed by the cleaning block D for cleaning the rotor and for re-adjusting the leading yarn end;

(4) The verifying block E for verifying spinning-in tests for determining the fundamental fiber supply, which block E is connected to the decision process R2 (together with the control sensor 12) and via the latter to 1;

(5) The adding block F for gradually adding time periods or values of the electronic adjustable timer 49 and (2);

(6) To the block G for optimalizing the fiber supply spinning-in parameter while;

(7) The optimalizing block G is connected, via decision process R5, on the one hand to the above-said splice joint quality evaluating circuit together with the decision process R3 for detecting the splice joint weight, and, on the other hand, to the repeating block K for repeating the spinning-in process, which block K is connected, via decision process R7, also to said quality evaluating circuit, i.e. to the decision process R3;

(8) The adding block F is connected, via cleaning block Fl and the decision process R10, back to the verifying block E and to the length verifying block A, said process RIO being moreover preceded by the limiting block F2 for determining the number of verifying spinning-in tests.

Figure 6:
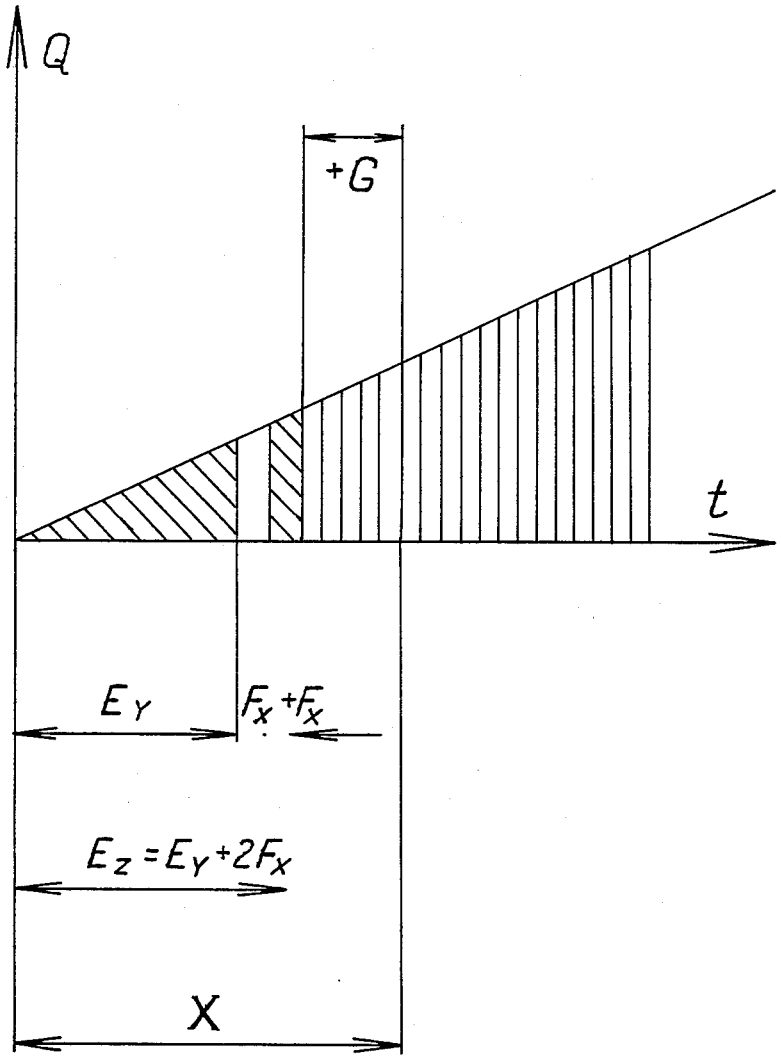
FIG. 6 is a graph showing fiber supply values plotted against time.

In the diagram in FIG. 6 which serves for better understanding the process for setting up the fiber supply spinning-in parameter, there are plotted on abscissa time values and on ordinate the fiber supply values Q. The fundamental fiber supply Ey is set up in the adjustable electronic timer 49 (FIG. 1) and is transmitted to the verifying block E, it being smaller than a minimum amount of fibers sufficient for spinning-in, say $Ey=0.2$ sec. Within this time period no spinning-in occurs, as results from the test in verifying block E so that the supply is increased by one degree $Fx=0.05$ sec., and the verifying test in the block E is repeated. Since either the first increase has not led to the spinning-in, the time will be increased by another degree Fx. In the exemplary experiment, the spinning-in has succeeded after the second increase.

In this way there is ascertained the primary spinning-in time value whereupon immediately an intentional breakage is effected. To this value $Ez=Ey+2Fx$ within which about 40–50% of fibers has been supplied, the optimalizing value G is added, which, in order to accelerate the spinning-in process, will replace e.g. 4 additional values Fx whereby the complete spinning-in parameter X is obtained. The parameter X is then registered in the adjustable electronic timer 49, transmitted to the corresponding element 4 of memory 3 for the normal spinning-in block J. The above-described process takes place only when the spinning unit or the spinning-in mechanism respectively, is to be re-adjusted. The time values as hereinabove set forth are exemplary only and need not necessarily be linear but can grow according to e.g. the equation Fx=1.4 Ey. In such a case, for example, the fundamental supply Ey can directly equal the value of additional time periods Fx.

Turning now to FIG. 3, when, according to a decision process R8, a new adjustment of spinning-in parameters is concerned, the micro-processor control system 2 switches on the block of program A for verifying tests to detect the yarn length to be returned, said program comprising switching on the drive of the reversing device 19 and metering the yarn return time interval by means of the sensor 16. In the embodiment shown in FIG. 2, said sensor 16 is a device for detecting the angle of reverse rotation of the yarn take-off device 20, constituted by a pulse counter of a disc having regularly spaced discontinuities such as teeth or holes thereon kinematically coupled with the roller of said take-off device 20.

In the decision process R1, the time point is ascertained, during the yarn return, at which the yarn end has contacted the rotating spinning rotor. Immediately after this contact recorded by the control sensor 12, the yarn return is ended by reversing device 19 whereupon in the next block of program B the thus ascertained spinning-in constant of the yarn return length interval is stored in the memory cell 4 (FIG. 1) of the respective spinning unit while adding the constant stored in the block of program C after the so-called additional spinning length given by the diameter of the spinning rotor. In accordance with the next program in the block D, the service device (not shown) cleans the spinning rotor and re-shapes the end of yarn introduced at a predetermined distance from the rotor. The basic constant for determining the instant of starting the fiber feed into the rotor is then released from the memory 3. This constant is to be preferably chosen so that the fiber reserve in the rotor be relatively low and could be raised in the course of the next successive test. Then a verifying test is effected in the program E, wherein at the instant given by the basic spinning-in constant, the fiber feeding device 21 is started. Depending on the spinning-in constant of the yarn return length interval, the reversing device 19 is also started. After the yarn return interval has elapsed, the micro-processor control system 2 switches off the drive of the reversing device 19 and sets the yarn take-off device 20 in operation.

In the next decision process R2, it is verified by evaluating the signal from the control sensor 12, whether the yarn spinning-in process has or has not been completed. For the latter case the next program block F is designed, in which the initial fiber reserve in the rotor is increased by one degree relative to the adjustment of the basic spinning-in constant, said increase being recorded in the memory cell 4.

After the spinning rotor has been cleaned and the yarn end re-shaped (see program block Fl), the operation proceeds again according to the program E in which the next verifying test is effected, whereupon in the decision process R2 it is verified, on the basis of signal from the control sensor 12, by evaluating said test whether the yarn has successfully been spun-in. If the spinning-in has not succeeded even in this case, the program block F intervenes whereby the initial fiber reserve in the spinning rotor is increased by another degree. If the yarn spinning-in fails even after the next successive verifying test the number of which is determined in program block F2 followed by the decision process R10, the search for automatically adjusted spinning-in constant for detecting an appropriate yarn length to be returned and a suitable instant for initiating the fiber feed to be spinning rotor, is repeated.

If the spinning-in after the verifying decision process R2 is successful, an intentional yarn breakage is provoked and the splice spot is severed by not shown means of the service device whereupon the program block G is set in operation for accelerating the optimalization of the spinning-in process by modifying the respective constant whereby to raise the strength of the splice spot, the supply of fibrous material to the rotor is increased. The yarn spinning-in is then verified again in the decision process R5 which is followed by the decision process R3 wherein the signal from the sensor 12 about the splice spot volume is evaluated. If this volume is within the limits of the control sensor tolerance, the decision process R4 follows in which the signal from the sensor 12 about the splice spot length is found to be in the tolerance the program block L for monitoring the normal spinning process is set in operation.

In the event the spinning-in in the decision process R5 fails for any of random reasons, the micro-processor control system 2 switches on the program block K in which, after cleaning the spinning rotor and re-shaping the yarn end, the verifying test with unchanged spinning-in parameters is effected. If need be, the verifying test is repeated as long as the yarn spinning-in is completed, which is ascertained in the decision process R7 and evaluated in the decision process R3 as to the splice spot volume. If the splice spot volume is within the predetermined tolerance limits of the control sensor 12, the decision process R4 for evaluating the splice spot length follows whereupon the above-mentioned program block L for monitoring the spinning process is set in operation.

If the splice spot volume does not correspond to the determined tolerances of the control sensor 12, the micro-processor control system 2 switches on the program block H which effects the tuning of the respective spinning-in constant by a corrected value which is stored in the memory cell 4 of the respective spinning unit.

In the following decision process R9 the length of the splice spot is evaluated. If the length does not correspond to the determined tolerances of the control sensor 12, the microprocessor control system 2 switches on the program block I in which a correction of the return yarn length is effected by correcting the spinning-in constant for determining the interval of yarn return into the spinning rotor. The corrected spinning-in constant is then stored in the memory cell of the respective spinning unit for re-using the thus modified spinning-in cycle.

After the spinning-in cycle has been corrected, the operation of the program block L follows whereby the normal spinning process in the spinning unit is monitored until the next yarn breakage occurs; in this case, the service device will carry out the spinning-in process according to the program J of the micro-processor control system 2. After this spinning-in process the decision process R6 follows wherein the control sensor 12 ascertains whether the yarn spinning-in has been successfully completed whereupon the evaluation of the splice spot quality follows in the decision processes R3, R4 so as to correct the spinning-in parameters, if need be.

In this way there is attained the adaptation of the spinning-in cycle, during the machine operation, to the existing state of the spinning units, wherein the spinning-in parameters are steadily made more exact to be adapted to varying spinning conditions.

Analogously, the spinning-in parameters are automatically adjusted for the spinning-in cycle governed by the control unit 1 of the traveling automatic service device 18 movable along the row of spinning units 25 in the open-end rotor spinning machine, each of them being provided with a thread breakage stop motion designed to switch off, in case of breakage, the drive of the fiber feeding device 21 for feeding the silver 29, by means of a signalling device. The signal causes the traveling automatic service device to stop its motion along the machine at the respective spinning unit and to effect the spinning-in cycle by its service elements.

As can be seen in FIG. 4, in the spinning-in process, the drive mechanism of the service device 18 lifts the yarn package 30 by swinging the arm 34 provided by the positively driven backing roll 33 which forms part of the reversing device 19 for returning yarn in the spinning-in process. Simultaneously, the spoon 35 is lifted by the automatic service device to its uppermost position whereby it thrusts the pressure roll 14 away from the take-off roller 26. The yarn to be spun-in is enabled in this manner to be introduced into the take-off tube 9 by not shown means. During the spinning-in process, the thread breakage stop motion is set by the traveling service device out of operation and its function is assumed by the control sensor 12 by swinging out the arm 36. After the spinning rotor has been cleaned and the yarn end re-shaped and introduced at a predetermined distance from the spinning rotor by not shown means of the traveling automatic service device the spinning-in process is started by the control unit 1 according to the spinning-in cycle wherein the spinning-in parameters are automatically adjusted by the successive verifying tests in the same manner as in the case the machine is equipped with the individual automatic service system.

During the spinning-in process, the fiber feeding device 21 is driven by the rotating advancing and retracting extension 39 which by its end portion 40 is in engagement with the feed roller. However, this arrangement does not exclude any other mode of controlling the fiber feeding device by the traveling automatic service device. After the spinning-in, the traveling service device 18 displaces the pressure roll 14 and the yarn package 30 back to their respective operative positions and sets in operation the thread breakage stop motion and simultaneously displaces the control sensor 12 and the extension 39 into their inoperative positions. The function of the program block L for monitoring the normal spinning operation of the spinning unit is replaced by that of the conventional thread breakage stop motion with which each spinning unit is provided.

By controlling the spinning-in process according to the spinning-in cycle the spinning-in parameters of which are automatically adjusted by verifying tests, it is made possible to successfully spin in yarn even in spinning units having varying dynamic characteristics the differences of which can be compensated for by correction values stored in the memory cells of the control unit.

By the automatic adjustment of the spinning-in parameters there is achieved not only an acceleration and a higher production of the yarn spinning-in processing in open-end rotor spinning machines, but also an improvement of the quality of yarn the splice spots of which are automatically controlled within the limits of predetermined toleranoes. Thus the negative results of a fixed spinning-in cycle with uniform parameters for all of the spinning units of the machine are eliminated.

Although the invention is described and illustrated with reference to a single embodiments thereof, it is to be expressly understood that it is in no way limited to the disclosure of such preferred embodiment but is capable of numerous modifications within the scope of the appended claims.

We claim:

1. A method for controlling a yarn spinning-in process in spinning units of open-end rotor spinning machines by means of a service device provided with a unit for controlling the fiber supply and the return of yarn into the spinning rotor for being spun-in, comprising spinning-in yarn according to a spinning-in cycle of the controlling unit;

measuring yarn spinning-in parameters of yarn return length and timing of initiating supply of fibers form a sliver;

automatically adjusting said parameters according to successive verifying measurements of the spinning-in parameters performed by the service device, the spinning-in parameters being automatically adjusted partly according to the successive measurements to ascertain a suitable yarn length to be returned by reversing means, and partly according to successive measurements to determine a suitable time point to initiate the supply of fiber to the spinning rotor by a feeding device;

the spinning-in parameters being chosen initially form a group of stored parameters;

returning the yarn from an initial position of yarn end into a collecting groove of the spinning rotor and deposited within a deposit yarn length onto a fibrous ribbon in said groove;

ascertaining a fundamental yarn length as the backward path of the yarn end from its entry point into the collecting groove to a point in which the yarn is first exposed to tension;

calculating said deposit yarn length in dependence on a yarn count to be produced and being added to said fundamental yarn length.

2. A method as claimed in claim 1 further comprising ascertaining said fundamental yarn length individually for two or more of said spinning units;

calculating the average fundamental yarn length; and using said average fundamental yarn length with respect to every spinning unit in the spinning-in process.

3. A method as claimed in claim 1 further comprising supplying a fiber amount to the collecting groove before the yarn end contacts a fibrous ribbon in said groove;

ascertaining fundamental fiber supply for a given yarn count as smaller than a minimum fiber amount sufficient for being spun-in;

gradually increasing said fundamental fiber supply by degrees in successive verifying measurements until attaining an optimal fiber amount sufficient for first spinning-in;

upon first spinning-in, effecting an intentional breakage and then adding an optimalizing fiber supply amount to said optimal fiber amount.

4. A method as claimed in claim 3 further comprising said fundamental fiber supply being associated with a fundamental time value which time value is increased by adding time periods within successive verifying measurements after the first spinning-in.

5. An apparatus for controlling a yarn spinning-in process in spinning units of open-end rotor spinning machines equipped with a service device provided with a controlling unit coupled to means for reversing yarn to and withdrawing it from a spinning rotor as well as to means for supplying fibers to said rotor, wherein the controlling unit comprises a programmable micro-processor control system for controlling a spinning-in cycle and for automatically adjusting the spinning-in parameters of yarn return length and timing of fiber feed initiation, the system being provided with input circuits and output circuits, said input circuits being coupled to checking means consisting of a control sensor and to a sensor for detecting the yarn length to be returned while the output circuits are coupled to a drive control of a yarn reversing device, a take-off device, and a fiber feeding device, the controlling unit being provided with a memory having memory cells for storing corrected values of spinning-in parameters, the memory being connected through a bus bar with the input and output circuits of the microprocessor control system;

the memory cells being associated with the spinning units and designed for recording the corrected values of spinning-in parameters of a cycle modified for these spinning units; and measuring means for ascertaining a fundamental yarn length as the backward path of a yarn end from its entry point into a collecting groove in a spinning rotor to a point in which the yarn is first exposed to tension;

storage means for storing said fundamental yarn length;

calculating means for calculating a deposit yarn length in dependence on a yarn count to be produced; and adding means for adding said deposit yarn length to said fundamental yarn length.

6. An apparatus as claimed in claim 5 further comprising a pick-up device for detecting the angles of reverse rotation of one of the yarn take-off device and the yarn reversing device, respectively.

7. An apparatus as claimed in claim 6 further comprising the pick-up device for detecting the angle of reverse rotation of one of the yarn take-off device and the yarn reversing device being a counter of pulses of a disc having regularly spaced check points thereon kinematically coupled to a driven cylinder of the respective device.

8. An apparatus as claimed in claim 5 further comprising an adjustable timer operatively connected to said bus bar for adjustably time periods of fiber feeding.

* * * * *